US006778206B2

(12) United States Patent
Kinjyou et al.

(10) Patent No.: US 6,778,206 B2
(45) Date of Patent: Aug. 17, 2004

(54) RECORDING APPARATUS

(75) Inventors: Kazuaki Kinjyou, Shizuoka (JP); Mitsuru Sawano, Kanagawa (JP); Seiji Hatakeyama, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 10 days.

(21) Appl. No.: 09/757,565

(22) Filed: Jan. 11, 2001

(65) Prior Publication Data

US 2001/0012048 A1 Aug. 9, 2001

(30) Foreign Application Priority Data

Jan. 12, 2000 (JP) ..... P.2000-003667
Jan. 4, 2001 (JP) ..... P.2001-000185

(51) Int. Cl.[7] ..... B41J 2/435
(52) U.S. Cl. ..... 347/263
(58) Field of Search ..... 347/262, 263, 347/23, 14, 17, 18, 223, 155, 165, 227, 245, 264, 138, 139, 152; 355/30; 118/46, 65

(56) References Cited

U.S. PATENT DOCUMENTS 4,414,913 A * 11/1983 Sarda ..... 118/46
4,996,939 A * 3/1991 D'Amato ..... 118/65
6,297,871 B1 * 10/2001 Hagiwara ..... 355/30

FOREIGN PATENT DOCUMENTS

| | | | | |
|---|---|---|---|---|
| CA | 2285885 | * | 10/1999 | ..... F24F/3/12 |
| JP | 57-18255 | * | 1/1982 | ..... B41F/7/24 |
| JP | 9-166954 | * | 6/1997 | ..... G03G/21/20 |

* cited by examiner

*Primary Examiner*—Hai Pham
(74) *Attorney, Agent, or Firm*—Sughrue Mion, PLLC

(57) ABSTRACT

A recording apparatus builds up positive pressure in its interior with air being supplied by a fan. Filter rejects any dust and dirt contained in the air so they will not enter the apparatus. Humidifier has a water-imbibed water-retaining material in its interior and humidifies the interior of the recording apparatus so that the internal humidity is always maintained at an optimum value. The recording apparatus ensures that there will be no change of the internal humidity that would otherwise deteriorate the performance of the constituent members of the apparatus or reduce the sensitivity of the sensitive material in the recording medium and this contributes to preventing unevenness in the finished image. The recording apparatus is also free from the development of static charge in the areas of contact between the recording medium and the constituent members and from the subsequent occurrence of transport jam and failures in electronic components.

18 Claims, 3 Drawing Sheets

RECORDING APPARATUS

BACKGROUND OF THE INVENTION

1. Field of the Invention

The present invention relates to an apparatus for recording imagery, characters and other kinds of information on recording media, particularly to an apparatus that performs recording while keeping its interior or the recording media at constant temperature or humidity.

2. Description of the Related Art

Recording heads such as thermal heads and laser heads can be used to record imagery, characters and other kinds of information. If the environment in such recording apparatus changes in terms of temperature or humidity, the performance of a constituent member such as the recording head or the recording sensitivity (hereunder referred to simply as "sensitivity") of the heat-sensitive material (hereunder referred to as the "sensitive material") in the recording medium varies, substantially affecting the finished image.

A conventional recording apparatus comprises a rotating recording drum (hereunder referred to as "recording drum") onto which is transported and fixed a recording medium (an image-receiving sheet and a plurality of sensitive materials such as toner sheets exemplified by standard K (black), C (cyan), M (magenta) and Y (yellow) toner sheets and sheets of specific colors such as gold and silver that are commonly used in the printing industry) and the recording medium is illuminated with laser light from a recording head to record imagery, characters and other kinds of information.

If the temperature in this conventional recording apparatus changes, it becomes difficult to ensure that uniform recording is done under identical conditions (in such terms as recording energy and time).

If the temperature in the recording apparatus decreases, the recording energy of the laser light issued from the recording head attenuates. Hence, the diameter of the beam spot projected from the recording head onto the recording medium becomes smaller than a specified value and, at the same time, the intensity of the laser light becomes insufficient to achieve satisfactory recording. As a result, the finished image becomes uneven and otherwise defective to cause serious effects, particularly on its quality if it is a color image. The same is true for the case where the temperature of the recording medium (hence, the sensitive material) decreases and in order to perform recording within the same duration of time, more recording energy is necessary, than when the temperature is high.

The sensitivity of the sensitive material also changes with the change in the humidity in the recording apparatus and it becomes difficult to ensure that uniform recording is done under identical conditions.

An optimum humidity of sensitive materials is generally about 70% and their sensitivity tends to decrease with decreasing humidity. Therefore, if the humidity within the recording apparatus is low, the humidity of the sensitive material also drops to lower its sensitivity and more recording energy is required than when the humidity is high.

In order to ensure that laser light having a specified value of recording energy is incident on the recording medium, one suffices to set the recording time for a larger value but this slows down the recording speed and cannot meet the demand for fast recording.

If the humidity in the recording apparatus is low, another problem occurs and that is the development of static charge in the areas where the recording medium contacts various constituent members of the apparatus. This static buildup is especially noticeable on the recording medium transport guide and transport jamming is a frequent problem. Static charge also affects the electronic components in the recording apparatus by, for example, causing failure in the flexible board.

On the other hand, since the dust brought into the recording apparatus causes definite adverse effects to it, it is preferable to keep the inside pressure of the recording machine positively by supplying the air from outside in order to overcome said problems, however, this makes it difficult to stabilize the temperature or humidity in the recording apparatus as discussed above.

To deal with these problems, temperature and humidity sensors are provided in the recording apparatus to detect the internal temperature and humidity and temperature- and humidity-corrected values for the recording conditions (such as laser modulation and scanning speeds) are calculated by software and the recording conditions are automatically adjusted on the basis of the calculated corrective values. However, the major problem of this prior art approach is that plenty of cost and time must be spent in developing the applicable software.

SUMMARY OF THE INVENTION

The present invention has been accomplished under these circumstances and has as an object providing an inexpensive recording apparatus that can control the internal temperature and humidity while keeping the positive pressure at the inside of the recording apparatus.

The stated object of the invention can be attained by the recording apparatus in this invention which comprises a medium fixing member for fixing a recording medium to its surface, a recording means for producing a record on said recording medium, and an air supply means for supplying air into the apparatus to build up positive pressure in its interior, characterized in that at least one member of the group consisting of a dehumidifying means, a humidifying means, a heating means and a cooling means is contained within said recording apparatus so that either temperature or humidity or both are held constant in said recording apparatus.

The recording apparatus in the second aspect of this invention is characterized in that at least one member of the group consisting of a dehumidifying means, a humidifying means, a heating means and a cooling means is located at the upstream of the air supply port of said air supply means so that either temperature or humidity or both of them are held constant in said recording apparatus.

The recording apparatus in the third aspect of this invention is characterized in that said humidifying means is located in the feed path of said recording medium.

The recording apparatus in the fourth aspect of this invention is characterized by further including a humidifying chamber and a humidifying air supply means for supplying air to said humidifying chamber, said humidifying means performing its function by a water-retaining material that is imbibed with water and which is located within said humidifying chamber or between said humidifying air supply means and said humidifying chamber.

The recording apparatus in the fifth aspect of this invention is characterized in that said humidifying means performs its function by a water-retaining roller that is brought into contact with or proximity to the supply path of the recording medium.

The recording apparatus in the sixth aspect of this invention is characterized by further including a temperature correcting means for correcting the recording energy of said recording means.

The recording apparatus in the seventh aspect of this invention is characterized by further including a temperature control means for controlling the temperature of said recording drum to optimize the temperature of said recording medium fixed on said recording drum.

In the recording apparatus in another aspect, a recording medium is fixed to the surface of a medium fixing member and a record is produced on the recording medium by a recording means, with air being supplied into the apparatus from outside of it by an air supply means to build up positive pressure in its interior. In the recording apparatus of claim 2, at least one member of the group consisting of a dehumidifying means, a humidifying means, a heating means and a cooling means is provided at the air supply port of the air supply means so that either temperature or humidity or both are held constant in the recording apparatus.

Thus, in the recording apparatus, at least one member of the group consisting of a dehumidifying means, a humidifying means, a heating means and a cooling means is provided at the air supply port of the air supply means so that either temperature or humidity or both are held constant (at an optimum value) in the recording apparatus to ensure that there will be no change of the temperature and humidity in the recording apparatus that would otherwise deteriorate the performance of its constituent members or reduce the sensitivity of the sensitive material in the recording medium. As a result, the recording apparatus can perform recording without waste of recording energy while preventing unevenness in the finished image. In the absence of humidity changes in its interior, the recording apparatus is free from the development of static charge in the areas of contact between the recording medium and the constituent members and from the subsequent transport jamming and failure in electronic components.

In the recording apparatus recited in in further aspect, a recording medium is fixed to the surface of a medium fixing member and a record is produced on the recording medium by a recording means, with air being supplied into the apparatus by an air supply means to build up positive pressure in its interior. In the recording apparatus of claim 3, a humidifying means is located in the feed path of the recording medium in order to keep its humidity constant.

Thus, in the recording apparatus, a humidifying means is provided in the feed path of the recording medium to humidify it so that its water content is kept at an optimum level. This ensures against the drop in the sensitivity of those sensitive materials which are particularly sensitive to humidity changes. As a result, the recording apparatus can perform recording without waste of recording energy while preventing unevenness in the finished image.

Take, for example, the humidifying means; it comprises a humidifying chamber and a humidifying air supply means and performs its function by a water-retaining material that is imbibed with water and which is located within the humidifying chamber or between the humidifying air supply means and the humidifying chamber. As a result, the water content of the recording medium is held at an optimum level.

Alternatively, the humidifying means performs its function by a water-retaining roller that is brought into contact with or proximity to the feed path of the recording medium. This is also effective in holding the water content of the recording medium at an optimum level.

DESCRIPTION OF THE PREFERRED EMBODIMENTS

Five modes for carrying out the present invention are described below in detail with reference to the accompanying drawings.

To begin with, we describe a recording apparatus according to the first mode for carrying out the invention.

In this mode, a humidifier is provided within the recording apparatus to keep the humidity in its interior at an optimum level. As a result, the recording apparatus is free from the development of static charge in the areas of contact between the recording medium and the constituent members and from the subsequent transport jamming and failure in electronic components. It can also perform recording without waste of recording energy while reducing adverse effects (e.g. unevenness) on the finished image.

Figure 1:
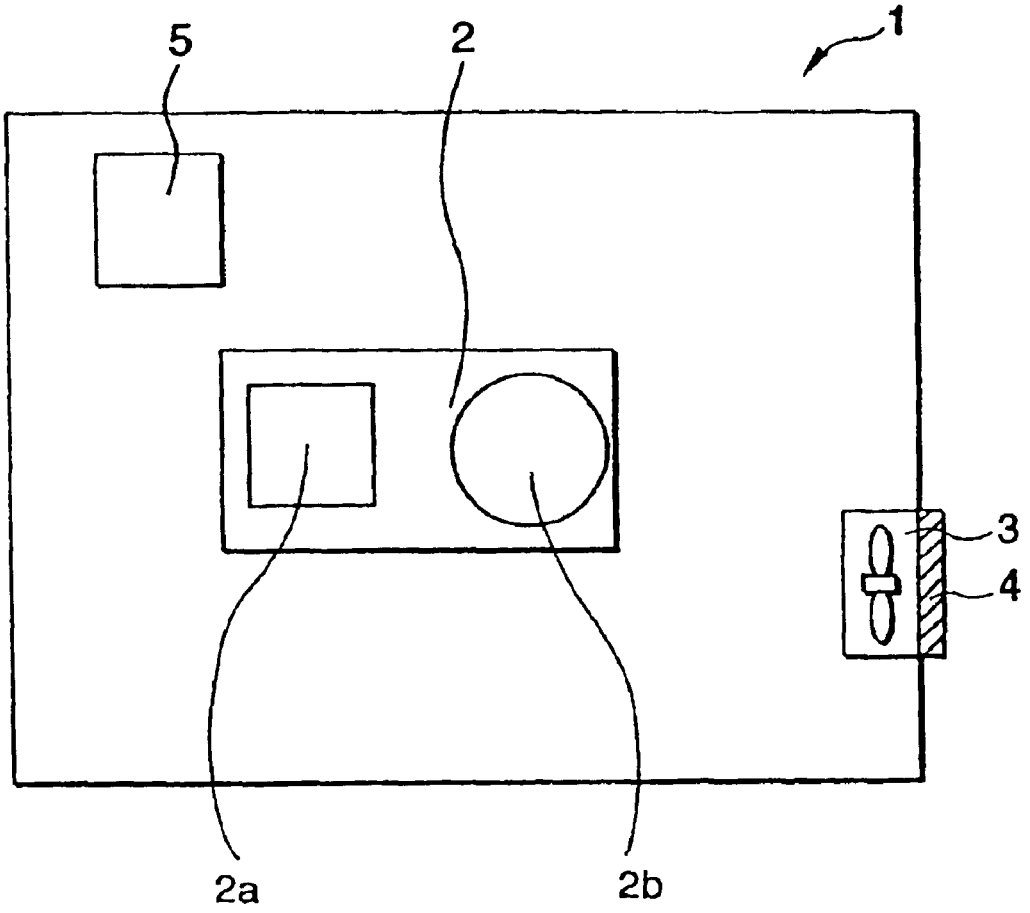
FIG. 1 is a schematic side view showing the layout of a recording apparatus according to the first mode for carrying out the invention.

FIG. 1 is a schematic side view showing the layout of the recording apparatus according to the first mode for carrying out the invention. The recording apparatus generally indicated by 1 comprises a recording section 2, a fan 3, a filter 4 and a humidifier 5.

The recording section 2 comprises a recording drum which corresponds to the medium fixing member 2*a* for fixing a recording medium on its surface and a recording head which corresponds to the recorder 2*b* for producing a record on the recording medium. The recording medium is transported and fixed onto the recording drum and illuminated with laser light from the recording head so that imagery, characters and other kinds of information are recorded on it.

The fan 3 corresponds to the air supply means which supplies air into the recording apparatus to build up positive pressure in its interior. The fan 3 is typically a Sirroco fan or a centrifugal fan which force air wind into the recording apparatus 1 to build up positive pressure in its interior so that there will be no ingress of dust or dirt through gaps.

The filter 4 rejects any dust and dirt that are contained in the air being forced into the apparatus 1.

The humidifier 5 corresponds to the humidifying means which holds the humidity in the recording apparatus 1 at an optimum level. Typically, the humidifier 5 has in its interior cotton swab or other water-retaining material imbibed with water so as to humidify the interior of the recording apparatus 1. As a result, the recording apparatus 1 is free from the development of static charge in the areas of contact between the recording medium and the constituent members and from the subsequent transport jamming and failure in electronic components. It can also perform recording without waste of recording energy while preventing the occurrence of unevenness in the finished image.

We next describe how the recording apparatus according to the first mode operates with the structural design described above. The recording apparatus 1 builds up positive pressure in its interior with air being supplied by means of the fan 3. The filter 4 rejects any dust and dirt contained in the air so they will not enter the apparatus 1. As a result, the recording apparatus can record imagery, characters and other kinds of information while preventing the ingress of dust and dirt through gaps by building up positive pressure in its interior. If the humidity in the recording apparatus 1 decreases, not only do the performance of constituent members such as the recording head and the sensitivity of the sensitive material deteriorate but also static charge develops in the areas of contact between the recording medium and constituent members of the recording apparatus 1. As a result, jamming occurs during transport of the recording medium or electronic components in the apparatus may fail and the finished image may experience unevenness. To avoid these problems, the recording apparatus 1 according to the first mode has in its interior a cotton swab imbibed with water so that the interior of the recording apparatus 1 remains humidified to keep the internal humidity at an optimum level. As a result, transport jam and failure of electronic components or defects such as unevenness in the finished image can be effectively prevented.

Figure 2A:
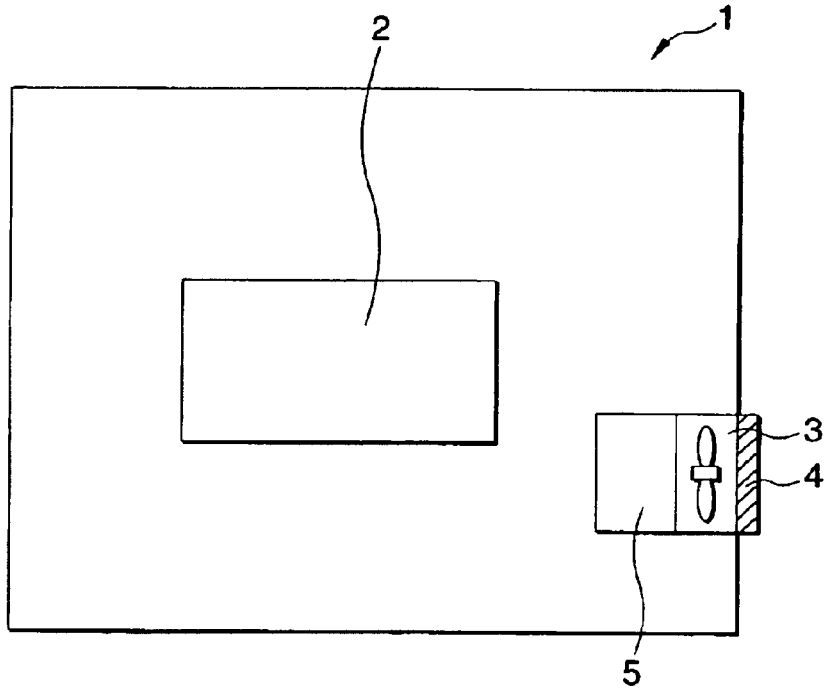
FIGS. 2A and 2B are schematic side views showing the layout of a recording apparatus with a humidifier located at the air inlet from a fan.
Figure 2B:
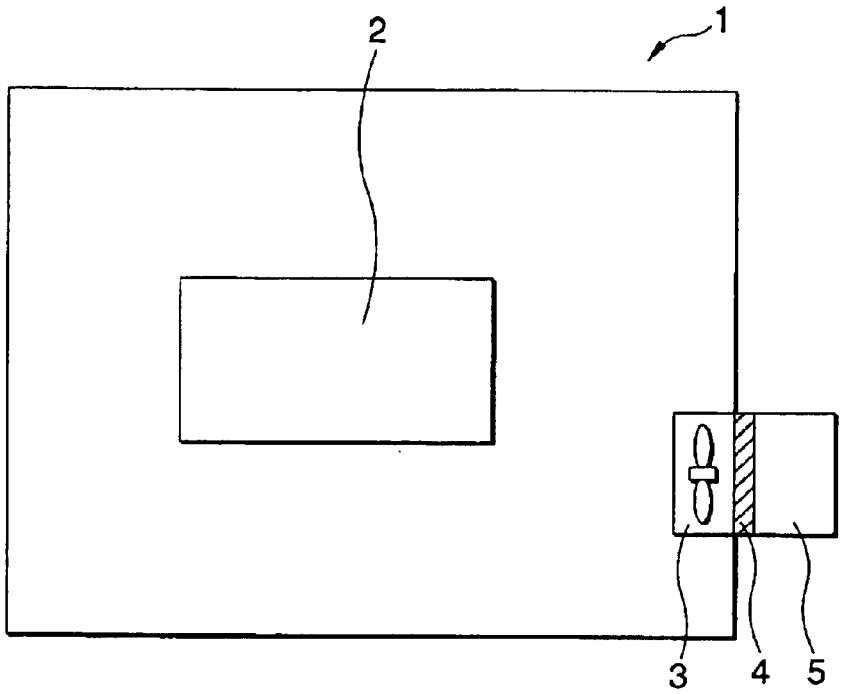

In the first mode for carrying out the invention, the humidifier 5 may be located at the port through which air is flowed into the recording apparatus 1 by means of the fan 3 as shown in FIG. 2A which is a schematic side view showing such layout of the apparatus 1.

As shown, the humidifier 5 is provided at the air inlet from the fan 3 so as to increase the water content of the air being supplied into the recording apparatus by means of the fan 3. As a result, the interior of the recording apparatus 1 is sufficiently humidified to prevent transport jam and failure of electronic components or defects such as unevenness in the finished image.

The same effect might be also achieved by providing the humidifier 5 at the upstream of the fan 3.

Further, the humidifier 5 might be located at the upstream of the fan 3 but apart from it by disposing the duct to communicate in-between.

Thus, according to the first mode for carrying out the invention, the humidifier 5 is provided within the recording apparatus 1 to keep an optimum level of humidity in its interior. Since the interior of the recording apparatus experiences no humidity changes, there will be no deterioration in the performance of its constituent members and the sensitivity of the sensitive material in the recording medium and the occurrence of unevenness in the finished image can be effectively prevented. It is also possible to prevent static buildup in the areas of contact between the recording medium and various constituent members, as well as the subsequent transport jam and failure in electronic components.

If the interior of the recording apparatus is humidified, the sensitivity of the sensitive material increases to allow for faster recording, thereby improving the throughput of the apparatus. If the recording speed is the same, less energy is needed.

If the humidity in the interior of the recording apparatus 1 is too high, a dehumidifier may be provided as a dehumidifying means and actuated to dehumidify the recording apparatus so that its internal humidity is kept at an optimum level. Alternatively, a heater or a cooler may be provided as a heating or cooling means, respectively, to control the temperature in the interior of the apparatus. If desired, the humidifier, dehumidifier, heater and cooler may be combined to set an optimum environment within the apparatus.

To control the temperature or humidity in its interior, the recording apparatus may further include a temperature or humidity sensor and a control section for controlling the humidifier, dehumidifier, heater or cooler; on the basis of the temperature or humidity reading obtained by the sensor, the control section controls the temperature of the heater or the humidity of the humidifier so as to adjust the temperature or humidity in the interior of the recording apparatus to an even better value.

In the recording apparatus according to the first mode described above, a humidifier is provided in its interior and the internal humidity is optimized to prevent not only deterioration in the performance of constituent members and the sensitivity of the sensitive material in the recording medium but also static buildup in the areas of contact between the recording medium and various constituent members. Since the sensitive material in the recording medium is especially sensitive to temperature or humidity changes that occur in the interior of the recording apparatus, a humidifying section may be provided in the feed path of the recording medium with a view to preventing the drop in its sensitivity so that there will be neither waste of the recording energy nor unevenness in the finished image. On the pages that follow, the second and third modes for carrying out the invention in which a humidifying section is provided in the feed path of the recording medium will be described in detail with reference to accompanying drawings.

[Second Mode]

We first describe the recording apparatus according to the second mode. Since a toner sheet is particularly sensitive to humidity changes, a humidifying chamber is provided in the feed path of the toner sheet to hold its water content (humidity) at an optimum level so that there will be no waste of the recording energy while reducing the adverse effects (such as unevenness) on the finished image.

Figure 3A:
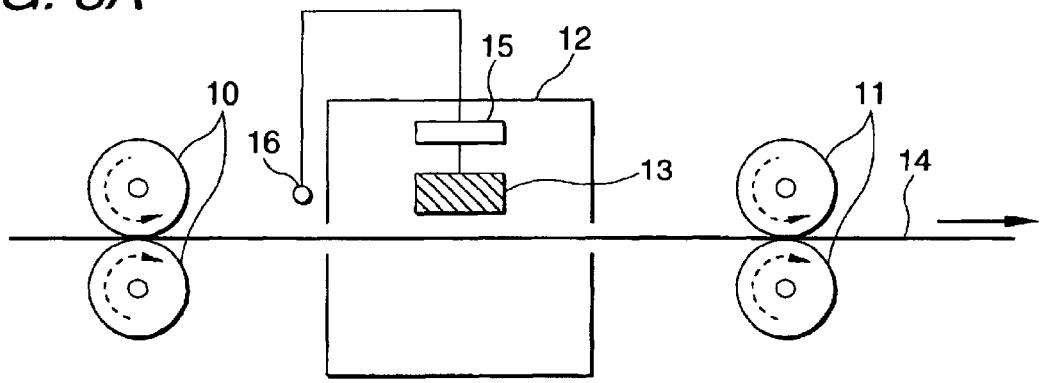
FIGS. 3A and 3B are simplified sections showing the feed path of a toner sheet in a recording apparatus according to the second mode for carrying out the invention.

FIG. 3A is a simplified section of the transport path of a toner sheet 14 in the recording apparatus according to the second mode. As shown, the recording apparatus has the following components arranged in the toner sheet feed path (over which the toner sheet 14 in the supply section is fed toward the recording drum): transport roller pairs 10 and 11, a humidifying chamber 12, a water-retaining material 13, a humidity control section 15 and a humidity sensor 16.

As the transport roller pairs 10 and 11 rotate in the directions indicated by the dashed lines, the toner sheet 14 held between the rolls of each pair is transported toward the recording drum (in the direction indicated by the solid line). To be more specific, the toner sheet 14 fed from its supply section (not shown) in a recording mode is transported toward the recording drum as it is held between the rollers of pair 10, then between the rollers of pair 11.

The humidifying section of the apparatus corresponds to the humidifying means provided in the feed path of the toner sheet 14 and consists of the humidifying chamber 12, water-retaining material 13, humidity control section and humidity sensor 16. The humidifying chamber 12 has in its interior the water-retaining material 13 such as cotton that is imbibed with water and humidifies the toner sheet 14 as it passes through the chamber 12. The humidity sensor 16 is provided in proximity to the toner sheet 14 and detects the humidity around it (which is hereunder designated "the humidity of the toner sheet 14"). The humidity control section 15 controls the water content of the water-retaining material 13 on the basis of the detected humidity of the toner sheet 14. Typically having a water supply portion that supplies water to the water-retaining material 13, the humidity control section 15 controls the supply of water in accordance with the humidity of the toner sheet 14.

We next describe how the recording apparatus according to the second mode operates with the structural design described above. In this recording apparatus, the toner sheet 14 fed from its supply section (not shown) in a recording mode is transported toward the recording drum (in the direction indicated by the solid line). First, the toner sheet 14 in its feed path is held between the rollers of pair 10 and as they rotate, the toner sheet 14 is transported toward the recording drum and drawn into the humidifying chamber 12.

If the humidity of the toner sheet 14 is unduly low, its sensitivity will drop, gravely affecting the finished image. To avoid this situation, in the second mode, the humidity sensor 16 detects the humidity around the toner sheet 14 and the humidity control section 15 adjusts the water content of the water-retaining material 13 on the basis of the detected sensitivity of the toner sheet 14. As a result, the moisture in the humidifying chamber 12 is adjusted and the water content of the toner sheet 14 passing through the chamber 12 is set at an optimum value, preventing the sensitivity of the toner sheet 14 from varying.

Having thusly acquired adequate water in the humidifying chamber 12, the toner sheet 14 is then held between the rollers of pair 11 and continues its transport toward the recording drum.

Figure 3B:
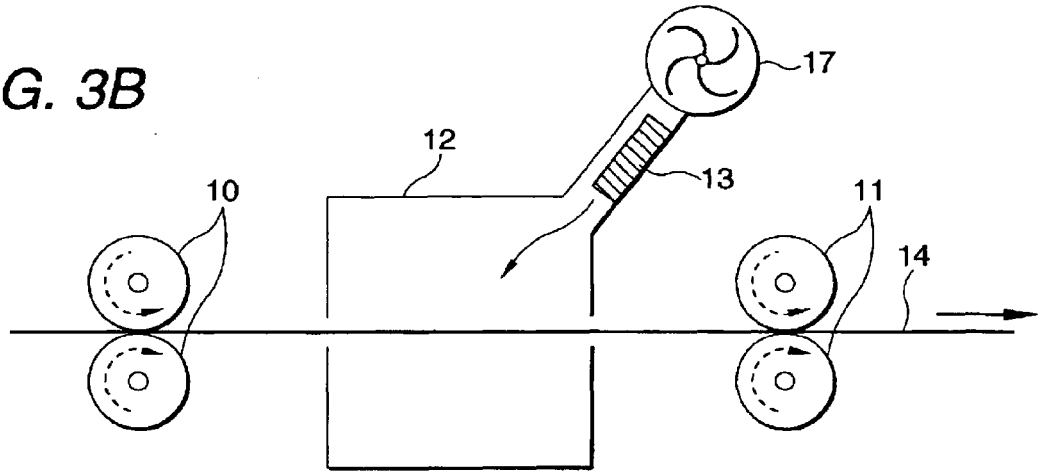

The recording apparatus according to the second mode may be adapted as shown in FIG. 3B by providing the humidifying section with a humidifying air supply portion 17 for supplying air into the humidifying chamber 12. As shown, a water-imbibed water-retaining material 13 is provided in the path of air flow into the humidifier 12 to increase the water content of incoming air so that the water content of the toner sheet 14 is held at an optimum value. Note that for the sake of simplicity, the humidity sensor and the humidity control section are omitted from FIG. 3B.

Thus, in the second mode for carrying out the invention, the humidifying chamber 12 is provided in the feed path of the toner sheet 14 so that it is humidified to have an optimum water content. As a result, the sensitivity of the toner sheet 14 which is highly sensitive to humidity changes is prevented from varying and there is no chance for the finished image to become uneven. In addition, the recording apparatus can perform its function with the recording energy being efficiently used to improve its throughput.

In this second mode, the humidifying chamber 12 is provided in the toner sheet feed path with a view to holding the humidity of the toner sheet 14 at an optimum level. Alternatively, at least one member of the group consisting of a dehumidifying chamber, a heating chamber and a cooling chamber may be provided in the toner sheet feed path so as to hold the temperature or humidity of the recording medium at an optimum level.

If desired, a heater may be provided within the transport roller pairs 10 and 11 to control the temperature of the toner sheet 14 being transported. In this case, the humidity control by the humidifying chamber 12 must be coordinated with the heater temperature.

In the second mode under consideration, the humidifying section is provided in the toner sheet feed path but it may be provided in the path where the recording medium is transported after recording with laser light; this is effective in preventing static buildup due to contact between the recording medium and various constituent members.

[Third Mode]

We next describe the recording apparatus according to the third mode for carrying out the invention. In this recording apparatus, a water-retaining roller is provided in the feed path of an image-receiving sheet to humidify it. This helps humidify the toner sheet which is superposed on the image-receiving sheet in a recording mode. As a result, the waste of the recording energy is prevented and the adverse effects on the finished image are reduced. Further, in the absence of the need to provide a humidifying chamber, the recording apparatus can be constructed with a simpler design and at a lower cost.

Figure 4:
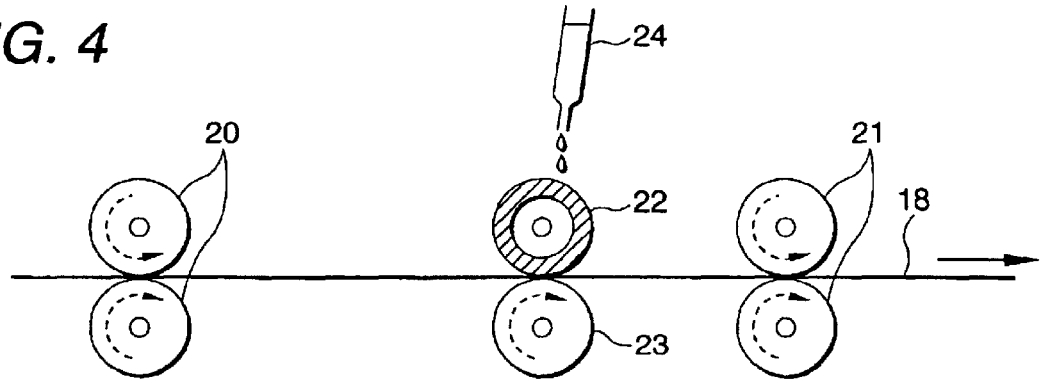
FIG. 4 is a simplified section showing the feed path of an image-receiving sheet in a recording apparatus according to the third mode for carrying out the invention.

FIG. 4 is a simplified section of the transport path of the image-receiving sheet 18 in the recording apparatus according to the third mode. As shown, the recording apparatus has transport roller pairs 20 and 21, a water-retaining roller 22, a transport roller 23 and a water supply section 24 in the feed path of the image-receiving sheet 18 (where it is fed from its supply section to the recording drum). The transport roller pairs 20 and 21 are identical to the transport roller pairs 10 and 11 used in the recording apparatus according to the second mode and need not be described in detail.

The water-retaining roller 22 corresponds to a humidifying means which is movably provided in proximity to the feed path of the image-receiving sheet 18; as the image-receiving sheet 18 is transported, the roller moves into contact with the image-receiving sheet 18 to humidify it. Typically, the water-retaining roller 22 is a transport roller wrapped with a water-retaining material such as a water-imbibed sponge; as it rotates in contact with the surface of the image-receiving sheet 18, the roller 22 humidifies the image-receiving sheet 18 which is transported through the nip between the roller 22 and the transport roller 23 which is rotating in synchronism with it. The transport roller 23 may itself be a water-retaining roller.

The water supply section 24 is for replenishing the water-retaining roller 22 with water. The amount of water to be supplied from this section may be determined by a humidity control section which controls the water supply to the sponge on the basis of the humidity of the image-receiving sheet 18 as detected by a humidity sensor (not shown). As a result, the water-retaining roller 22 can be replenished with the necessary amount of water for humidifying the image-receiving sheet 18.

We next describe how the recording apparatus according to the third mode operates with the structural design described above. The image-receiving sheet 18 fed from its supply section is first nipped through the transport roller pair 20, then between the water-retaining roller 22 and the transport roller 23 and transported toward the recording drum. Since the water-retaining roller 22 is wrapped with a water-imbibed sponge, it can humidify the image-receiving sheet 18. The sponge on the water-retaining roller 22 is supplied with water from the water-supply section 24. Typically, a humidity sensor and a humidity control section (neither shown) are provided and the humidity of the image-receiving sheet 18 is detected by the humidity sensor and in accordance with the detected humidity value, the amount of water to be supplied from the water supply section 24 is controlled by the humidity control section and water is accordingly supplied to the water retaining roller 22.

If the humidity of the image-receiving sheet 18 is low, more water is supplied from the water supply section 24 so that the water-retaining roller holds a sufficiently increased amount of water to increase the humidity of the image-receiving sheet 18 as it passes in contact with the water-retaining roller. This eventually increases the humidity of the toner sheet as it is superposed on the image-receiving sheet 18 in a recording mode. If the humidity of the image-receiving sheet 18 is high, the water content of the water-retaining roller is lowered. In this way, the water content of the image-receiving sheet 18 is adjusted as it is transported in contact with the water-retaining roller 22 and one can increase the humidity of the toner sheet which is superposed on the image-receiving sheet 18 in a recording mode. As a result, there will be no drop in the sensitivity of the sensitive material in the recording medium.

The humidified image-receiving sheet 18 is transported through the nip of the transport roller pair 21 toward the recording drum.

Thus, in the third mode for carrying out the invention, the water-retaining roller 22 is provided in the feed path of the image-receiving sheet 18 to humidify it. This helps increase the humidity of the toner sheet as it is superposed on the image-receiving sheet 18 in a recording mode. As a result, the sensitivity of a sensitive material in the recording medium which is particularly sensitive to humidity changes is prevented from varying and there is no chance for the finished image to become uneven. In addition, the recording apparatus can perform its function with the recording energy being efficiently used to improve its throughput.

In this third mode, the water-retaining roller 22 is provided in the image-receiving sheet feed path as a humidifying device with a view to holding the humidity of the image-receiving sheet 18 at an optimum level. Alternatively, at least one member of the group consisting of a humidifying chamber, a dehumidifying chamber, a heating chamber and a cooling chamber may be provided in the image-receiving sheet feed path so as to hold the temperature or humidity of the image-receiving sheet 18 at an optimum level.

If desired, a heater may be provided within the transport roller pairs 20 and 21 to control the temperature of the image-receiving sheet 18 being transported. In this case, the humidity control by the water-retaining roller 22 must be coordinated with the heater temperature.

As described on the foregoing pages, the present invention provides an inexpensive recording apparatus that can control the internal temperature or humidity.

Further, the recording apparatus of the invention ensures that there will be no change in the internal humidity or the humidity of the recording medium that would otherwise deteriorate the performance of the constituent members of the apparatus or reduce the sensitivity of the sensitive material in the recording medium and this contributes to preventing unevenness in the finished image. The recording apparatus is also free from the development of static charge in the areas of contact between the recording medium and the constituent members and from the subsequent occurrence of transport jam and failures in electronic components.

What is claimed is:

1. A recording apparatus comprising:

a medium fixing member for fixing a recording medium to its surface;

a recorder for producing a record on said recording medium; and an air supply for supplying air into the apparatus to build up positive pressure in its interior;

wherein at lease one member of the group consisting of a dehumidifier, a humidifier, a heater and a cooler is contained within said recording apparatus so that either temperature or humidity or both are held constant in said recording apparatus; and wherein the at least one member of the group consisting of the dehumidifier, the humidifier, the heater, and the cooler is the humidifier, and said humidifier is located in a feed path of said recording medium.

2. The recording apparatus according to claim 1, wherein said humidifier performs its function by a water-retaining roller that is brought into contact with or proximity to the feed path of the recording medium.

3. The recording apparatus according to claim 1, wherein said humidifier comprises a humidifying chamber.

4. The recording apparatus according to claim 3, further comprising a humidity sensor and a water-retaining material disposed within the humidifying chamber.

5. A recording apparatus comprising:

a medium fixing member for fixing a recording medium to its surface;

a recorder for producing a record on said recording medium; and an air supply formed on a surface of the apparatus for supplying outside air into the apparatus to build up positive pressure in its interior;

wherein at least one member of the group consisting of a dehumidifier, a humidifier, a heater and a cooler is located upstream of an air supply port of said air supply so that either temperature or humidity or both are held constant in said recording apparatus.

6. The recording apparatus according to claim 5, wherein the at least one member of the group consisting of the dehumidifier, the humidifier, the heater, and the cooler is the humidifier, and wherein the humidifier is coupled to the air supply port.

7. A recording apparatus comprising:

a medium fixing member for fixing a recording medium to its surface;

a recorder for producing a record on said recording medium;

an air supply for supplying air into the apparatus to build up positive pressure in its interior;

wherein at least one member of the group consisting of a dehumidifier, a humidifier, a heater and a cooler is contained within said recording apparatus so that either temperature or humidity or both are held constant in said recording apparatus;

wherein the at least one member of the group consisting of the dehumidifier, the humidifier, the heater, and the cooler is the humidifier, and said humidifier is located in a feed path of said recording medium; and a humidifying chamber and a humidifying air supply for supplying air to said humidifying chamber, said humidifier performing its function by a water-retaining material that is imbibed with water and which is located within said humidifying chamber or between said humidifying air supply and said humidifying chamber.

8. The recording apparatus according to claim 7, wherein said water-retaining material comprises a water-retaining roller that is brought into contact with or proximity to the feed path of the recording medium.

9. A recording apparatus comprising:

a medium fixing member for fixing a recording medium to its surface;

a recorder for producing a record on said recording medium; and an air supply for supplying air into the apparatus to build up positive pressure in its interior, wherein:

at least one of a humidifier and a dehumidifier is contained within said recording apparatus so that humidity can be held constant in said recording apparatus; and the at least one of a humidifier and a dehumidifier is the humidifier, and said humidifier comprises a humidifying chamber and a humidifying air supply for supplying air to said humidifying chamber, said humidifier performing its function by a water-retaining material that is imbibed with water and which is located within said humidifying chamber or between said humidifying air supply and said humidifying chamber.

10. The recording apparatus according to claim 1, wherein said humidifier is located in a feed path of said recording medium.

11. A recording apparatus comprising:

a medium fixing member for fixing a recording medium to its surface;

a recorder for producing a record on said recording medium; and an air supply for supplying air into the apparatus to build up positive pressure in its interior, wherein:

at least one of a humidifier and a dehumidifier is contained within said recording apparatus so that humidity can be held constant in said recording apparatus; and the at least one of a humidifier and a dehumidifier is the humidifier, and said humidifier performs its function by a water-retaining roller that is brought into contact with or proximity to a feed path of the recording medium.

12. A recording apparatus comprising:

a medium fixing member for fixing a recording medium to its surface;

a recorder for producing a record on said recording medium;

an air supply for supplying air into the apparatus to build up positive pressure in its interior;

at least one of a humidifier and dehumidifier contained within said recording apparatus so that humidity can be held constant in said recording apparatus; and at least one of a cooler and a heater contained within said recording apparatus so that temperature can be held constant in the recording apparatus, wherein the at least one of a humidifier and a dehumidifier is the humidifier, and the humidifier comprises a humidifying chamber and a humidifying air supply for supplying air to said humidifying chamber, said humidifier performing its function by a water-retaining material that is imbibed with water and which is located within said humidifying chamber or between said humidifying air supply and said humidifying chamber.

13. A recording apparatus comprising:

a medium fixing member for fixing a recording medium to its surface;

a recorder for producing a record on said recording medium;

an air supply for supplying air into the apparatus to build up positive pressure in its interior;

at least one of a humidifier and dehumidifier contained within said recording apparatus so that humidity can be held constant in said recording apparatus; and at least one of a cooler and a heater contained within said recording apparatus so that temperature can be held constant in the recording apparatus, wherein the at least one of a humidifier and a dehumidifier is the humidifier, and said humidifier is located in a feed path of said recording medium.

14. The recording apparatus according to claim 13, wherein said humidifier performs its function by a water-retaining roller that is brought into contact with or proximity to the feed path of the recording medium.

15. A recording apparatus comprising:

a medium fixing member for fixing a recording medium to its surface;

a recorder for producing a record on said recording medium; and an air supply for supplying air into the apparatus to build up positive pressure in its interior, wherein:

at least one of a humidifier and a dehumidifier is contained within said recording apparatus so that humidity can be held constant in said recording apparatus;

the at least one of a humidifier and a dehumidifier is the humidifier; and the humidifier is coupled to an air supply port of said air supply.

16. A recording apparatus comprising:

a medium fixing member for fixing a recording medium to its surface;

a recorder for producing a record on said recording medium; and an air supply for supplying air into the apparatus to build up positive pressure in its interior, wherein:

at least one of a humidifier and a dehumidifier is contained within said recording apparatus so that humidity can be held constant in said recording apparatus;

the at least one of a humidifier and a dehumidifier is the humidifier; and the humidifier comprises a humidifying chamber.

17. The recording apparatus according to claim 16, further comprising a humidity sensor and a water-retaining material disposed within the humidifying chamber.

18. A recording apparatus comprising:

a medium fixing member for fixing a recording medium to its surface;

a recorder for producing a record on said recording medium;

an air supply for supplying air into the apparatus to build up positive pressure in its interior;

at least one of a humidifier and dehumidifier contained within said recording apparatus so that humidity can be held constant in said recording apparatus; and at least one of a cooler and a heater contained within said recording apparatus so that temperature can be held constant in the recording apparatus, wherein the at least one of a humidifier and a dehumidifier is the humidifier; and the humidifier is coupled to an air supply port of said air supply.

* * * * *